US011407958B2

(12) United States Patent
Kikabhai et al.

(10) Patent No.: US 11,407,958 B2
(45) Date of Patent: Aug. 9, 2022

(54) LUBRICANT COMPOSITIONS

(71) Applicant: CASTROL LIMITED, Reading (GB)

(72) Inventors: Thakor Kikabhai, Reading (GB); Laura De Laguno Gorria, Reading (GB); Bernadeta Anna Pochopien, Reading (GB); Peter Timothy Seden, Reading (GB)

(73) Assignee: Castrol Limited, Reading (GB)

( * ) Notice: Subject to any disclaimer, the term of this patent is extended or adjusted under 35 U.S.C. 154(b) by 0 days.

(21) Appl. No.: 17/290,223

(22) PCT Filed: Oct. 29, 2019

(86) PCT No.: PCT/EP2019/079503
§ 371 (c)(1),
(2) Date: Apr. 29, 2021

(87) PCT Pub. No.: WO2020/089212
PCT Pub. Date: May 7, 2020

(65) Prior Publication Data

US 2021/0403824 A1 Dec. 30, 2021

(30) Foreign Application Priority Data

Oct. 29, 2018 (GB) ..... 1817589

(51) Int. Cl.
*C10M 129/74* (2006.01)
*C10M 169/04* (2006.01)
(Continued)

(52) U.S. Cl.
CPC ..... *C10M 129/74* (2013.01); *C10M 169/04* (2013.01); *C10M 2207/283* (2013.01);
(Continued)

(58) Field of Classification Search
CPC ..... C10M 105/40; C10M 129/76; C10M 2207/289; C10M 129/74; C10M 169/04;
(Continued)

(56) References Cited

U.S. PATENT DOCUMENTS 4,304,678 A * 12/1981 Schick ..... C10M 129/76 508/308
4,336,149 A * 6/1982 Erdman ..... C10M 129/76 508/501
(Continued)

FOREIGN PATENT DOCUMENTS

CN 101098950 A 1/2008
EP 0092946 B1 3/1988
(Continued)

OTHER PUBLICATIONS

Lasenor, "VEROL IG 90", Mar. 16, 2009 (Mar. 16, 2009), XP055657274 URL:https://www.ulprospector.com/documents/1133349.pdf?bs=5444&b=200309&st=20&r=eu&ind=food [retrieved on Jan. 13, 2020].
(Continued)

*Primary Examiner* — Ellen M McAvoy
(74) *Attorney, Agent, or Firm* — McDonnell Boehnen Hulbert & Berghoff LLP

(57) ABSTRACT

A lubricant composition comprises an anti-wear and or/friction modifying additive which is an ester of a fatty acid and a polyol. At least 50% by weight of the additive is in the form of a mono-ester, and is preferably a mono-glyceride. The lubricant composition may be used in an internal combustion engine.

18 Claims, 1 Drawing Sheet

(51) Int. Cl.

| | |
|---|---|
| *C10N 30/00* | (2006.01) |
| *C10N 40/00* | (2006.01) |
| *C10N 40/04* | (2006.01) |
| *C10N 30/06* | (2006.01) |
| *C10N 40/02* | (2006.01) |
| *C10N 40/06* | (2006.01) |
| *C10N 40/20* | (2006.01) |
| *C10N 40/25* | (2006.01) |

(52) U.S. Cl.
CPC ..... *C10N 2030/06* (2013.01); *C10N 2030/54* (2020.05); *C10N 2040/02* (2013.01); *C10N 2040/042* (2020.05); *C10N 2040/06* (2013.01); *C10N 2040/135* (2020.05); *C10N 2040/20* (2013.01); *C10N 2040/25* (2013.01)

(58) Field of Classification Search
CPC ..... C10M 2207/283; C10N 2030/06; C10N 2030/54; C10N 2040/02; C10N 2040/042; C10N 2040/06; C10N 2040/135; C10N 2040/20; C10N 2040/25
USPC ..... 508/501
See application file for complete search history.

(56) References Cited

U.S. PATENT DOCUMENTS

| | | | | |
|---|---|---|---|---|
| 4,376,056 | A * | 3/1983 | Erdman | C10M 129/76 508/501 |
| 4,376,711 | A | 3/1983 | Shaub | |
| 4,952,328 | A * | 8/1990 | Davis | C10M 129/95 508/237 |
| 4,957,651 | A * | 9/1990 | Schwind | C10M 129/76 508/331 |
| 4,959,168 | A * | 9/1990 | Schroeck | C07G 17/002 508/331 |
| 5,114,603 | A * | 5/1992 | Kennedy | C10M 159/22 508/486 |
| 6,844,298 | B2 * | 1/2005 | Prince | C10M 173/00 508/209 |
| 7,622,431 | B2 | 11/2009 | Muir | |
| 7,935,508 | B2 | 5/2011 | Schorken et al. | |
| 2005/0075254 | A1 * | 4/2005 | Pollock | C10L 10/08 508/486 |
| 2005/0198894 | A1 | 9/2005 | Migdal et al. | |
| 2006/0090393 | A1 | 5/2006 | Rowland et al. | |
| 2007/0213234 | A1 | 9/2007 | Yaghmur et al. | |
| 2008/0280795 | A1 * | 11/2008 | Fujitsu | C10M 161/00 508/472 |
| 2013/0072408 | A1 * | 3/2013 | Adams | C10L 1/1905 44/404 |
| 2014/0162922 | A1 * | 6/2014 | Verhaeghe | C10L 10/08 508/501 |
| 2015/0191672 | A1 | 7/2015 | Hanyuda et al. | |
| 2015/0203779 | A1 * | 7/2015 | Hanyuda | C10M 129/76 123/1 A |
| 2018/0016511 | A1 * | 1/2018 | Guiducci | C10L 1/191 |
| 2020/0362259 | A1 * | 11/2020 | Simms | C10M 129/36 |
| 2021/0054299 | A1 * | 2/2021 | Maruyama | C10M 107/02 |

FOREIGN PATENT DOCUMENTS

| | | | |
|---|---|---|---|
| EP | 1533362 | A1 | 5/2005 |
| GB | 2097813 | A | 11/1982 |
| WO | 1999/021902 | A1 | 5/1999 |
| WO | 2003/099890 | A2 | 12/2003 |
| WO | 2006061436 | A1 | 6/2006 |
| WO | 2006/099250 | A1 | 9/2006 |
| WO | 2008/124191 | A1 | 10/2008 |

OTHER PUBLICATIONS

Robert O. Dunn. "Effects of Monoacylglycerols on the Cold Flow Properties of Biodiesel," Journal of the American Oil Chemists' Society, 2012, 89(8):1509-1520.

International Search Report and Written Opinion of the International Searching Authority for International Application No. PCT/EP2019/079503, completed May 7, 2020.

C. Yvonne Thiel and Thomas E. Hayden, SAE International, Paper # 2001-01-1962, The Fuel Additive/Lubricant Interactions: Compatibility Assessments in Field Studies and Laboratory Tests, published May 7, 2001, Abstract.

* cited by examiner

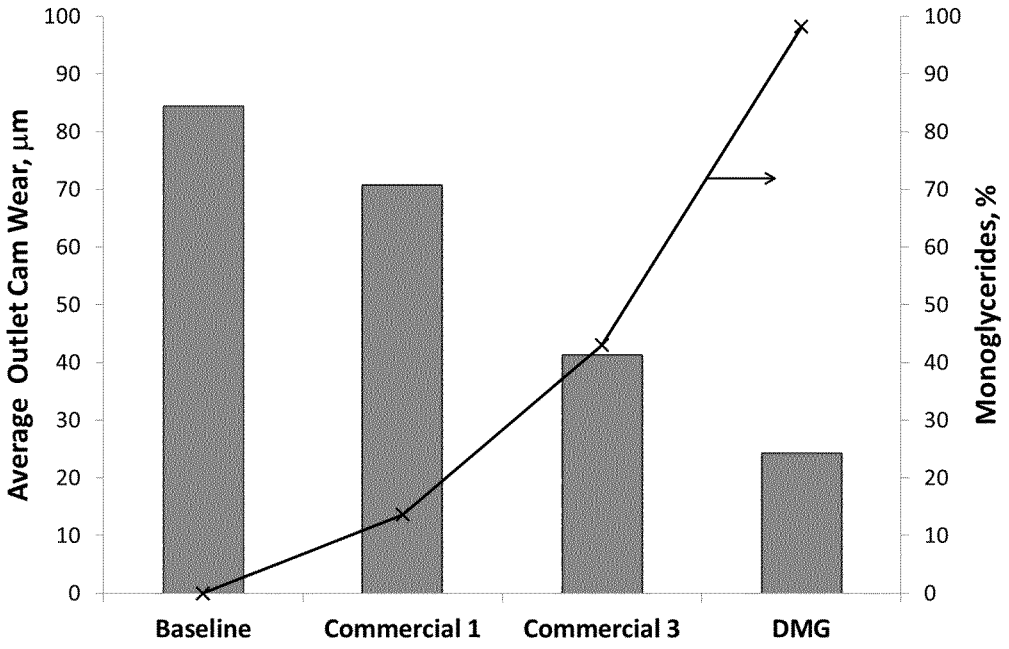
Average Outlet Cam Wear, µm
Monoglycerides, %
100
90
80
70
60
50
40
30
20
10
0
Baseline
Commercial 1
Commercial 3
DMG

LUBRICANT COMPOSITIONS

This application is a national stage application under 35 U.S.C. § 371 of International Application No. PCT/EP2019/079503, filed Oct. 29, 2019, which claims priority to Great Britain Application No. 1817589.3, filed Oct. 29, 2018, the disclosures of which are explicitly incorporated by reference herein.

FIELD OF THE INVENTION

The present invention relates to lubricant compositions comprising an ester of a fatty acid and a polyol. In particular, the present invention relates to lubricant composition comprising an ester of a fatty acid and polyol which is effective as anti-wear and/or friction modifying additive. The lubricant compositions are particularly suitable for use in internal combustion engines.

BACKGROUND OF THE INVENTION

Lubricant compositions generally comprise one or more base oils of lubricating viscosity together with one or more additives. Lubricant additives are used to deliver certain properties to the lubricant, such as improved viscosity index, detergency and resistance to oxidation and corrosion.

Additives may also be used to reduce friction and wear between surfaces, such as surfaces in an internal combustion engine.

Zinc dihydrocarbyl dithiophosphates (ZDDP) have been used as anti-wear additives in lubricant compositions for many years. A disadvantage of these additives is that, when used to lubricate internal composition engines, they give rise to ash which contributes to particulate matter in the exhaust emissions from the internal combustion engines. It is therefore desirable to reduce the amount of ash-forming additives used for lubricating internal combustion engines. It is also desirable to reduce the amount of zinc and/or phosphorus and/or sulfur in the exhaust emissions from internal combustion engines. A range of anti-wear additives and/or friction modifiers which contain neither zinc nor phosphorus, or at least contain them in reduced amounts, have therefore been produced.

Organic friction modifiers (OFMs) are a class of friction modifying additive that has become very popular for use in lubricants, and particularly in lubricants for internal combustion engines. OFMs typically have a polar head group which is attracted to the metal surfaces found in an engine, and a hydrophobic tail which helps to create a thin lubricating layer at the metal surface.

Glycerol mono-oleate (GMO) is known as an OFM. For instance, WO 2008/124191 discloses the use of one or more oil-soluble fatty acid esters of a polyol as a friction modifier in a lubricating oil composition having a base oil comprising a major amount of a gas-to-liquid (GTL) derived base oil.

U.S. Pat. No. 4,376,711 relates to a lubricant composition and an additive comprising a hydroxy-substituted ester of a polycarboxylic acid and a metal dihydrocarbyl dithiophosphate. Particularly desirable results are said to have been obtained with additives prepared by esterifying a dimer of a fatty acid, particularly those containing conjugated unsaturation with a polyhydroxy compound.

GB 2097813 relates to fuel economy promoting lubricating oil compositions which comprise an oil of lubricating viscosity and, as the fuel economy additive, from 0.05 to 0.2 weight percent of a glycerol partial ester of a $C_{16}$-$C_{18}$ fatty acid. The composition is illustrated with glycerol mono-oleate and glycerol di-oleate.

EP 0092946 relates to glycerol esters with oil-soluble copper compounds as fuel economy additives for lubricant compositions. The preferred ester is said to be a glycerol mono- or di-ester of a saturated or unsaturated $C_{16}$-$C_{18}$ fatty acid.

However, the existing GMO compositions that are used in lubricants are actually mixtures of a number of different mono-, di- and tri-glycerides. Indeed, commercially available GMO compositions typically comprise a minor amount of mono-glyceride (typically from 10 to 45%), with the bulk of the composition being made up of di- and tri-glycerides. Thus, previous disclosures of the properties of GMO additives in lubricant compositions are really disclosures relating to mixtures of glycerides containing a low amount of mono-glyceride.

Glyceride mixtures are also limited in the amount in which they can be used in a lubricant composition before problems with solubility, corrosion, compatibility with other components and demulsification may occur. Accordingly, there exists a need for additive compositions which are effective in reducing wear and/or friction, but which exhibit fewer problems than the mixtures of glycerides previously used in lubricants.

Distilled mono-glycerides (DMGs) are purified glyceride compositions having a high content of mono-glycerides compared to conventional glyceride compositions. DMGs are commercially available and are produced by distilling oils, such as vegetable oils, which contain glycerides. As a result of the distillation process, DMGs will generally have greater than 60% by weight mono-glycerides, though the mono-glyceride content is commonly much higher, e.g. greater than 90%.

DMG compositions are commonly used in the food industry. In particular, they have been widely used to increase the shelf life of bread, to improve crumb structure and volume in cakes and to form stable emulsions in margarines and spreads. DMGs have not previously been used in lubricant or fuel compositions.

There remains a need for additive compositions exhibiting anti-wear and/or friction modifying properties for use in lubricant compositions.

SUMMARY OF THE INVENTION

The present invention is based on the surprising discovery that, by using an additive composition comprising an ester of a fatty acid and a polyol in which at least 50% by weight of the ester is in the form of a mono-ester, such as a distilled mono-glyceride composition, the anti-wear and/or friction modifying performance of a lubricant composition is improved.

Accordingly, the present invention provides a lubricant composition comprising an anti-wear and/or friction modifying additive which is an ester of a fatty acid and a polyol, wherein at least 50% by weight of the additive is in the form of a mono-ester (hereinafter referred to as the "ester additive defined herein").

Also provided is a method for preparing a lubricant composition as defined herein, said method comprising blending:

an oil of lubricating viscosity; and the ester additive defined herein.

The present invention further provides the use of the ester additive defined herein in a lubricant composition, as well as its use as an anti-wear and/or friction modifying additive in a lubricant composition.

The use of a lubricant composition of the present invention for reducing wear and/or friction on a surface is also provided, as well as its use for improving the fuel economy and/or power of an internal combustion engine in which the lubricant composition is used.

Further provided is a method in which the anti-wear and/or friction-modifying properties of a lubricant composition are improved, said method comprising introducing an ester additive defined herein to the lubricant composition.

The present invention also provides a method for reducing wear and/or friction on a surface, said method comprising applying a lubricant composition as defined above to the surface.

According to another aspect of the present invention, there is provided a method for improving the fuel economy and/or power of an internal combustion engine, said method comprising supplying a lubricant composition as defined above to the engine.

BRIEF DESCRIPTION OF THE FIGURES

FIG. 1 is a graph showing the average outlet camshaft wear that was achieved by a lubricant composition of the present invention, two lubricant compositions each containing a different commercially available glycerol mono-oleate (GMO) composition and a baseline in the OM646LA engine test.

DETAILED DESCRIPTION OF THE INVENTION

The present invention relates to lubricant compositions comprising an anti-wear and/or friction modifying ester additive.

The Ester Additive

The ester additive used in the present invention is an ester of a fatty acid and a polyol, such as glycerol. Thus, the ester additives defined herein are free from metals, as well as from sulfur and phosphorus, and so their use does not suffer from the same drawbacks as many of the prior art friction modifiers such as zinc dihydrocarbyl dithiophosphates.

At least 50% by weight of the ester additive defined herein is in the form of a mono-ester. In preferred embodiments, at least 70%, and more preferably at least 80% by weight of the ester additive defined herein is in the form of a mono-ester.

In some embodiments, all of the ester may be in the form of a mono-ester. However, there will generally be less than 100% mono-ester. The remainder of the ester is made up of esters of a fatty acid and a polyol which are not mono-esters, such as di-esters, tri-esters, etc. of a fatty acid and a polyol. For instance, in the case of a glycerol polyol, the remainder of the ester may be made up of di-glycerides, tri-glycerides and mixtures thereof.

Fatty acids are compounds which contain a carboxylic acid group attached to a hydrocarbyl chain. Fatty acids are typically mono-carboxylic acids.

At least 70%, preferably at least 80%, and more preferably at least 90% by weight of the fatty acids in the ester are selected from $C_{10-25}$ fatty acids, preferably from $C_{12-22}$ fatty acids, and more preferably from $C_{16-20}$ fatty acids. Similarly, at least 70%, preferably at least 80%, and more preferably at least 90% by weight of the fatty acids in the mono-ester are selected from $C_{10-25}$ fatty acids, preferably from $C_{12-22}$ fatty acids, and more preferably from $C_{16-20}$ fatty acids. The remainder of the fatty acids (if any) will typically be selected from $C_{4-28}$ fatty acids.

The fatty acid in the ester may be saturated or unsaturated. However, it is generally preferred that at least 70%, preferably at least 80%, and more preferably at least 90% by weight of the fatty acid in the ester is saturated or comprises one or two double bonds, and more preferably comprises one or two double bonds. It is also preferred that at least 70%, preferably at least 80%, and more preferably at least 90% by weight of the fatty acid in the mono-ester is saturated or comprises one or two double bonds, and more preferably comprises one or two double bonds.

In particularly preferred embodiments, at least 70%, preferably at least 80%, and more preferably at least 90% by weight of the fatty acid in the ester are:

selected from $C_{10-25}$ fatty acids, preferably from $C_{12-22}$ fatty acids, and more preferably from $C_{16-20}$ fatty acids; and are saturated, or comprise one or two double bonds.

Preferably, at least 70%, preferably at least 80%, and more preferably at least 90% by weight of the fatty acid in the mono-ester are:

selected from $C_{10-25}$ fatty acids, preferably from $C_{12-22}$ fatty acids, and more preferably from $C_{16-20}$ fatty acids; and are saturated, or comprise one or two double bonds.

Preferred fatty acids for use in the ester additive defined herein include palmitic acid (C16:0, i.e. hexadecanoic acid), stearic acid (C18:0, i.e. octadecanoic acid), oleic acid (C18:1 cis-9, i.e. (9Z)-octadec-9-enoic acid) and linoleic acid (C18:2 cis-9,12, i.e. (9Z,12Z)-octadeca-9,12-dienoic acid). Particularly preferred are the $C_{18}$ fatty acids, in particular oleic acid and linoleic acid.

In some embodiments, at least 20%, preferably at least 30%, and more preferably at least 40% by weight of the fatty acid in the ester is selected from $C_{18}$ fatty acids; preferably from oleic acid, linoleic acid and mixtures thereof. Preferably, at least 20%, preferably at least 30%, and more preferably at least 40% by weight of the fatty acid in the mono-ester is selected from $C_{18}$ fatty acids; preferably from oleic acid, linoleic acid and mixtures thereof. Mixtures of oleic acid and linoleic acid are particularly preferred.

Where the fatty acid in the ester comprises linoleic acid and oleic acid, the ratio by weight of linoleic acid to oleic acid in the ester may be from 1:10 to 6:1, preferably from 1:8 to 4:1, and more preferably from 1:5 to 3:1. Similarly, the ratio by weight of linoleic acid to oleic acid in the mono-ester may be from 1:10 to 6:1, preferably from 1:8 to 4:1, and more preferably from 1:5 to 3:1. In particular embodiments, the ratio by weight of linoleic acid to oleic acid in the ester, and preferably also in the mono-ester, is greater than 1:1.

The fatty acids in the ester may be branched or linear, but will generally be linear.

The content of different fatty acids in a composition may be measured according to AOCS-Ce 1c-89 or IUPAC led. Method 2.301.

Polyols are organic compounds which contain two or more hydroxyl groups and, typically, no other functional groups.

Preferably, the polyol will comprise at least 3 hydroxyl groups. The polyol may comprise up to 5 hydroxyl groups. Thus, the polyol may comprise from 3 to 5, preferably 3 or 4, and more preferably 3 hydroxyl groups.

The polyol may be selected from $C_{2-10}$ polyols, preferably from $C_{2-8}$ polyols, and more preferably from $C_{3-5}$ polyols.

The polyol may be branched or unbranched, though will typically be branched.

Suitable polyols include ethylene glycol, propylene glycol, glycerol and sorbitol. In preferred embodiments, the polyol is glycerol.

Where the polyol is glycerol, at least 80%, preferably at least 90%, more preferably at least 95% by weight of the mono-ester is in the form of a 1-mono-glyceride.

The ester additives defined herein may be prepared by reacting a polyol with a fatty acid feedstock in an esterification reaction.

In some embodiments, the reaction conditions (e.g. the molar ratio of polyol to fatty acid) will be controlled to ensure that the resulting ester additive has the desired properties, including greater than 50% by weight mono-esters. Alternatively or additionally, the esterification reaction product may purified, e.g. by chromatography, to provide an ester additive including greater than 50% by weight mono-esters.

However, in preferred embodiments, a glyceride feedstock which comprises less than 50% by weight of mono-glycerides is distilled to give a distilled mono-glyceride (DMG) composition. During distillation, the proportion of mono-glyceride is increased relative to the other components to give DMG composition having greater than 50%, and usually higher, by weight mono-glycerides.

Thus, in some embodiments, the ester additive is in the form of a DMG composition.

Suitable glyceride feedstocks may be derived, e.g. by glycerolysis, from vegetable oils, such as from cottonseed oil, grapeseed oil, olive oil, palm oil, rapeseed oil, soya bean oil and/or sunflower oil, and preferably for example sunflower and/or palm oil. These oils often comprise high proportions of tri-glycerides and therefore require refining, e.g. by heating in the presence of a catalyst, to increase the proportion of mono- and di-glycerides before use as a glyceride feedstock.

Whilst the DMG composition may be prepared, it may also be purchased as an additive which is commonly used in the food industry. For instance, VEROL IG 90® produced by Lasenor and DIMODAN® by Danisco are distilled mono-glyceride compositions which are suitable for use in the present invention.

Lubricant Compositions

The ester additives defined herein may be used as part of a lubricant composition. The lubricant composition will typically be non-aqueous lubricant compositions.

The lubricant composition may comprise greater than 50%, preferably greater than 65%, and more preferably greater than 80% of an oil of lubricating viscosity, such as a base oil.

Base oils comprise at least one base stock. Base stocks which are suitable for use in the lubricant composition of the present invention include non-aqueous base stocks such as Group I, Group II, Group III, Group IV and Group V base stocks, as classified according to API standard 1509, "ENGINE OIL LICENSING AND CERTIFICATION SYSTEM", 17th Edition, Annex E (October 2013 with Errata March 2015):

| Group | Saturated hydrocarbon content (% by weight) ASTM D2007 | | Sulfur content (% by weight) ASTM D2622 or D4294 or D4927 or D3120 or D1552 | | Viscosity Index ASTM D2270 |
|---|---|---|---|---|---|
| I | <90 | and/or | >0.03 | and | ≥80 and <120 |
| II | ≥90 | and | ≤0.03 | and | ≥80 and <120 |

-continued

| Group | Saturated hydrocarbon content (% by weight) ASTM D2007 | | Sulfur content (% by weight) ASTM D2622 or D4294 or D4927 or D3120 or D1552 | | Viscosity Index ASTM D2270 |
|---|---|---|---|---|---|
| III | ≥90 | and | ≤0.03 | and | ≥120 |
| IV | | | polyalphaolefins | | |
| V | | | all base stocks not in Groups I, II, III or IV | | |

In addition to an oil of lubricating viscosity, the lubricant composition of the present invention comprises an ester additive defined herein. The ester additive may be present in the lubricant composition at a concentration of at least 0.02%, preferably at least 0.05%, and more preferably at least 0.1% by weight of the lubricant composition. The ester additive may be present in the lubricant composition at a concentration of up to 5%, preferably up to 4%, and more preferably up to 2.5% by weight of the lubricant composition. Thus, the ester additive may be present in the lubricant composition at a concentration of from 0.02 to 5%, preferably from 0.05 to 4%, and more preferably from 0.1 to 2.5% by weight of the lubricant composition.

The lubricant composition may also comprise one or more further lubricant additives.

The one or more further lubricant additives include detergents (including metallic and non-metallic detergents), friction modifiers other than the ester additive defined herein, dispersants (including metallic and non-metallic dispersants), viscosity modifiers, dispersant viscosity modifiers, viscosity index improvers, pour point depressants, anti-wear additives other than the ester additive defined herein, rust inhibitors, corrosion inhibitors, antioxidants (sometimes also called oxidation inhibitors), anti-foams (sometimes also called anti-foaming agents), seal swell agents (sometimes also called seal compatibility agents), extreme pressure additives (including metallic, non-metallic, phosphorus containing, non-phosphorus containing, sulfur containing and non-sulfur containing extreme pressure additives), surfactants, demulsifiers, anti-seizure agents, wax modifiers, lubricity agents, anti-staining agents, chromophoric agents, metal deactivators, and mixtures of two or more thereof.

Examples of suitable detergents include ashless detergents (that is, non-metal containing detergents) and metal-containing detergents. Suitable non-metallic detergents are described for example in U.S. Pat. No. 7,622,431. Metal-containing detergents comprise at least one metal salt of at least one organic acid, which is called soap or surfactant. Suitable organic acids include for example, sulfonic acids, phenols (suitably sulfurised and including for example, phenols with more than one hydroxyl group, phenols with fused aromatic rings, phenols which have been modified for example, alkylene bridged phenols, and Mannich base-condensed phenols and saligenin-type phenols, produced for example by reaction of phenol and an aldehyde under basic conditions) and sulfurised derivatives thereof, and carboxylic acids including for example, aromatic carboxylic acids (for example hydrocarbyl-substituted salicylic acids and derivatives thereof, for example hydrocarbyl substituted salicylic acids and sulfurised derivatives thereof).

Examples of suitable friction modifiers (other than the ester additive defined herein) include for example, ash-producing additives and ashless additives. Examples of suitable friction modifiers include fatty acid derivatives including for example amides, amines, and ethoxylated amines. Examples of suitable friction modifiers also include molybdenum compounds for example, organo molybdenum compounds, molybdenum dialkyldithiocarbamates, molybdenum dialkylthiophosphates, molybdenum disulfide, trimolybdenum cluster dialkyldithiocarbamates, non-sulfur molybdenum compounds and the like. Suitable molybdenum-containing compounds are described for example, in EP 1533362 A1 for example in paragraphs [0101] to [0117].

Examples of suitable ashless dispersants include oil soluble salts, esters, amino-esters, amides, imides and oxazolines of long chain hydrocarbon-substituted mono- and polycarboxylic acids or anhydrides thereof; thiocarboxylate derivatives of long chain hydrocarbons; long chain aliphatic hydrocarbons containing polyamine moieties attached directly thereto; Mannich condensation products formed by condensing a long chain substituted phenol with formaldehyde and polyalkylene polyamine; Koch reaction products and the like.

Examples of suitable dispersant viscosity modifiers and methods of making them are described in WO 99/21902, WO 2003/099890 and WO 2006/099250.

Examples of suitable viscosity modifiers include high molecular weight hydrocarbon polymers (for example polyisobutylene, copolymers of ethylene and propylene and higher alpha-olefins); polyesters (for example polymethacrylates); hydrogenated poly(styrene-co-butadiene or isoprene) polymers and modifications (for example star polymers); and esterified poly(styrene-co-maleic anhydride) polymers. Oil-soluble viscosity modifying polymers generally exhibit number average molecular weights of at least 15000 to 1000000, preferably 20000 to 600000 as determined by gel permeation chromatography or light scattering methods.

Examples of suitable pour point depressants include $C_8$ to $C_{18}$ dialkyl fumarate/vinyl acetate copolymers, methacrylates, polyacrylates, polyarylamides, polymethacrylates, polyalkyl methacrylates, vinyl fumarates, styrene esters, condensation products of haloparaffin waxes and aromatic compounds, vinyl carboxylate polymers, terpolymers of dialkyfumarates, vinyl esters of fatty acids and allyl vinyl ethers, wax naphthalene and the like.

Examples of suitable anti-wear additives (other than an ester additive defined herein) include non-phosphorus containing additives for example, sulfurised olefins. Examples of suitable anti-wear additives also include phosphorus-containing antiwear additives. Examples of suitable ashless phosphorus-containing anti-wear additives include trilauryl phosphite and triphenylphosphorothionate and those disclosed in paragraph [0036] of US 2005/0198894. Examples of suitable ash-forming, phosphorus-containing anti-wear additives include dihydrocarbyl dithiophosphate metal salts. Examples of suitable metals of the dihydrocarbyl dithiophosphate metal salts include alkali and alkaline earth metals, aluminium, lead, tin, molybdenum, manganese, nickel, copper and zinc. Particularly suitable dihydrocarbyl dithiophosphate metal salts are zinc dihydrocarbyl dithiophosphates (ZDDP).

Examples of suitable rust inhibitors include non-ionic polyoxyalkylene polyols and esters thereof, polyoxyalkylene phenols, polyoxyalkylene polyols, anionic alky sulfonic acids, zinc dithiophosphates, metal phenolates, basic metal sulfonates, fatty acids and amines.

Examples of corrosion inhibitors include phosphosulfurised hydrocarbons and the products obtained by the reaction of phosphosulfurised hydrocarbon with an alkaline earth metal oxide or hydroxide, non-ionic polyoxyalkylene polyols and esters thereof, polyoxyalkylene phenols, thiadiazoles, triazoles and anionic alkyl sulfonic acids. Examples of suitable epoxidised ester corrosion inhibitors are described in US 2006/0090393.

Examples of suitable antioxidants include alkylated diphenylamines, N-alkylated phenylenediamines, phenyl-a-naphthylamine, alkylated phenyl-a-naphthylamines, dimethylquinolines, trimethyldihydroquinolines and oligomeric compositions derived therefrom, hindered phenolics (including ashless (metal-free) phenolic compounds and neutral and basic metal salts of certain phenolic compounds), aromatic amines (including alkylated and non-alkylated aromatic amines), sulfurised alkyl phenols and alkali and alkaline earth metal salts thereof, alkylated hydroquinones, hydroxylated thiodiphenyl ethers, alkylidenebisphenols, thiopropionates, metallic dithiocarbamates, 1,3,4-dimercaptothiadiazole and derivatives, oil soluble copper compounds (for example, copper dihydrocarbyl thio- or thio-phosphate, copper salts of a synthetic or natural carboxylic acids, for example a $C_8$ to $C_{18}$ fatty acid, an unsaturated acid or a branched carboxylic acid, for example basic, neutral or acidic Cu(I) and/or Cu(II) salts derived from alkenyl succinic acids or anhydrides), alkaline earth metal salts of alkylphenolthioesters, suitably containing $C_5$ to $C_{12}$ alkyl side chains, calcium nonylphenol sulfide, barium t-octylphenyl sulfide, dioctylphenylamine, phosphosulfised or sulfurised hydrocarbons, oil soluble phenates, oil soluble sulfurised phenates, calcium dodecylphenol sulfide, phosphosulfurised hydrocarbons, sulfurised hydrocarbons, phosphorus esters, low sulfur peroxide decomposers and the like.

Examples of suitable anti-foam agents include silicones, organic polymers, siloxanes (including poly siloxanes and (poly) dimethyl siloxanes, phenyl methyl siloxanes), acrylates and the like.

Examples of suitable seal swell agents include long chain organic acids, organic phosphates, aromatic esters, aromatic hydrocarbons, esters (for example butylbenzyl phthalate) and polybutenyl succinic anhydride.

Other additives may also be present in the lubricant composition and these include, for example, extreme pressure additives (including metallic, non-metallic, phosphorus containing, non-phosphorus containing, sulfur containing and non-sulfur containing extreme pressure additives), surfactants, demulsifiers, anti-seizure agents, wax modifiers, lubricity agents, anti-staining agents, chromophoric agents and metal deactivators.

In some embodiments, the lubricant composition may comprise solvent e.g. which has been used to ensure that the additives are in a form in which they can be stored or combined with the lubricant. Examples of suitable solvents include highly aromatic, low viscosity base stocks, for example 100N, 60N and 100SP base stocks.

Representative typical and more typical independent amounts of additives (if present) in the lubricant composition are given in the table below. For the additives, the concentrations are expressed by weight (of the base fuel) of active additive compounds, i.e. independent of any solvent or diluent. Where more than one additive of each type is present in the lubricant composition, the total amount of each type of additive is expressed in the table below.

| Additive type | Lubricant composition: Suitable amount (actives) if present by weight | Lubricant composition: Preferred amount (actives) if present by weight |
|---|---|---|
| Ester additive defined herein | 0.02 to 5% | 0.1 to 2.5% |
| Phosphorus-containing anti-wear additives | Corresponding to 10 to 6000 ppm P | Corresponding to 10 to 1000 ppm P |
| Molybdenum-containing anti-wear additives | Corresponding to 10 to 1000 ppm Mo | Corresponding to 40 to 600 ppm Mo |
| Boron-containing anti-wear additives | Corresponding to 10 to 500 ppm B | Corresponding to 50 to 100 ppm B |
| Friction modifiers other than the ester additive defined herein | 0.01 to 5% | 0.01 to 1.5% |
| Molybdenum-containing friction modifiers | Corresponding to 10 to 1000 ppm Mo | Corresponding to 400 to 600 ppm Mo |
| Dispersants | 0.1 to 20% | 0.1 to 8% |
| Detergents | 0.01 to 6% | 0.01 to 4% |
| Viscosity index improvers | 0.01 to 20% | 0.01 to 15% |
| Pour point depressants | 0.01 to 5% | 0.01 to 1.5% |
| Corrosion and/or rust inhibitors | 0.01 to 5% | 0.01 to 1.5% |
| Anti-oxidants | 0.01 to 10% | 0.5 to 5% |
| Antifoams containing silicon | Corresponding to 1 to 20 ppm Si | Corresponding to 1 to 10 ppm Si |

Preferred lubricant compositions meet the requirements set out in SAE J300 (2015-01), and preferably exhibit an SAE viscosity grade of 30 or lower.

The lubricant compositions of the present invention may be prepared by a method which comprises blending: an oil of lubricating viscosity; and an anti-wear and/or friction modifying ester additive defined herein. Suitable methods for blending lubricant compositions are known in the art.

The method may further comprise blending one of more of the above-mentioned lubricant additives into the lubricant composition. The additives are may be used in the form of additive concentrates or as part of an additive pack which contains more than one additive, optionally comprising solvent or diluent.

Uses and Methods

The ester additive defined herein is used in a lubricant composition, e.g. a lubricant composition described above. Preferably, the ester additive is used as an anti-wear and/or friction modifying additive in the lubricant composition.

The lubricant composition may be used in an internal combustion engine, wheel bearings, door hinges, gears, marine applications, robotics, turbines and other industrial application. The lubricant composition may be used as a functional fluid (e.g. metalworking fluids which may be used to lubricate metals during machining, rolling and the like), or a transmission fluid (e.g. as an automatic transmission fluid, e.g. in a drive line, gear box, or clutch (e.g. a dual clutch)).

The lubricant composition is preferably used in an internal combustion engine, e.g. as a crankcase lubricant. Suitable internal combustion engines include spark-ignition engines (which typically run on petroleum fuels, e.g. direct injection and port fuel injection engine) and compression ignition engines (which typically run on diesel fuel).

The internal combustion engine may be used to power an automotive vehicle (e.g. a car or lorry), an aeroplane, or a marine vessel. Thus, the lubricant composition may be an automotive lubricant, an aviation lubricant or a marine lubricant.

The lubricant composition of the present invention may be used for reducing wear and/or friction on a surface. Thus, a method for reducing wear and/or friction on a surface may comprise applying the lubricant composition of the present invention to the surface.

The surface is preferably found in an internal combustion engine. For instance, the lubricant composition may be used for reducing wear and/or friction on the camshaft, particularly the camshaft outlet.

The ester additive may be used to lubricate a surface at temperature which might typically be encountered in a lubricating environment, such as at a temperature such as may be encountered in an internal combustion engine, e.g. a temperature in the range of ambient to 250° C., e.g. 90° C. to 120° C. Typical ambient temperature is 20° C., but in at least some examples, is less than 20° C., for example 0° C. or lower.

Preferably the ester additives described herein improve the anti-wear properties of a lubricant composition to which they are added. The efficacy of the ester additives described herein for imparting anti-wear properties onto a lubricant composition may be tested according to the OM646LA (CEC L-99-08) engine wear test, in particular by looking at camshaft outlet wear in the OM646LA engine wear test.

The ester additives described herein may also improve the friction modifying properties of a lubricant composition to which they are added. The efficacy of the ester additives described herein for imparting friction modifying properties onto a lubricant composition may be tested according to the High Frequency Reciprocating Rig (HFRR) friction test, as described in detail in Example 2.

Since the ester additives defined herein reduce friction and/or wear in a lubricant for an internal combustion engine, they may be used for improving the fuel economy and/or power of an internal combustion engine in which the lubricant is used. Thus, a method for improving the fuel economy and/or power of an internal combustion engine may comprise supplying the lubricant composition of the present invention to the engine.

Though it is generally preferred for a blended lubricant to be supplied to the engine, the ester additive defined herein may also be added into the lubricant within the engine in which the hydrocarbon fluid is used, e.g. by addition of the additive to the oil sump, or by addition of the additive directly into the combustion chamber. As discussed in more detail below, the ester additive defined herein may also be transferred to the lubricant from a fuel into which the additive has been combined.

It will also be appreciated that the ester additive may be added to the lubricant composition in the form of a precursor compound which, under the combustion conditions encountered in an engine, breaks down to form an ester additive defined herein.

Fuel Compositions

In some embodiments, the ester additive defined herein may be transferred to the lubricant from a fuel into which the additive has been combined during operation of an engine in which the fuel and lubricant are used, thereby providing anti-wear and/or friction modifying benefits to the engine. The ingress of fuel and fuel additives into the crankcase lubricant of an internal combustion engine is known, for example from paragraph 2 of the abstract of SAE paper 2001 January 2062 by C. Y. Thiel et al. "The Fuel Additive/lubricant Interactions: . . . "

Thus, the present invention provides a fuel composition which comprises an ester additive defined herein. The ester-additive defined herein may be present in the fuel at a concentration of from 5 to 500 ppm by weight, for example 10 to 300 ppm by weight or 20 to 200 ppm by weight. The present invention also provides the use of an ester additive defined herein in a fuel composition, e.g. as an anti-wear and/or friction modifying additive.

The fuel composition is preferably for use in an internal combustion, e.g. an internal combustion engine as described above.

Suitable liquid fuels, particularly for internal combustion engines, include hydrocarbon fuels, oxygenate fuels and combinations thereof. Hydrocarbon fuels may be derived from mineral sources and/or from renewable sources such as biomass (e.g. biomass-to-liquid sources) and/or from gas-to-liquid sources and/or from coal-to-liquid sources. Suitable sources of biomass include sugar (e.g. sugar to diesel fuel) and algae. Suitable oxygenate fuels include alcohols, for example straight and/or branched chain alkyl alcohols having from 1 to 6 carbon atoms, esters, for example fatty acid alkyl esters and ethers, for example methyl tert butyl ether. Suitable fuels may also include LPG-diesel fuels (LPG being liquefied petroleum gas).

One or more further fuel additives may be present in the fuel composition.

The fuel composition may be prepared by blending a fuel with an ester additive defined herein.

Further provided is the use of the fuel composition for:

reducing wear and/or friction on a surface, such as a surface in an internal combustion engine; and/or improving the fuel economy and/or power of an internal combustion engine, e.g. as a result of ingress of the additive into the lubricant that is used in the engine, e.g. the crankcase lubricant.

Also provided is a method for:

reducing wear and/or friction in an internal combustion engine, and/or improving the fuel economy and/or power of an internal combustion engine said method comprising supplying the fuel composition to the engine.

The method may further comprise operating the engine, i.e. such that the ester additive defined herein ingresses from the fuel into the lubricant that is used in the engine, e.g. the crankcase lubricant.

EXAMPLES

The invention will now be described with reference to the following non-limiting examples.

Example 1: Cameron Plint Wear Tests

A non-aqueous lubricant comprising a base oil and a conventional additive package was prepared having an SAE J300 viscosity grade of OW-20. The lubricant was free from esters of a fatty acid and a polyol.

A lubricant composition of the present invention was prepared by adding 0.5% w/w of two-different distilled mono-glyceride compositions, VEROL IG 90® (Lasenor) and DIMODAN® (Danisco), to the non-aqueous lubricant. The first distilled mono-glyceride composition (VEROL IG 90®; DMG1) contained 98% by weight mono-glyceride, of which 25% by weight was glycerol mono-oleate and 64.5% was glycerol mono-linoleate. The second distilled mono-glyceride composition (DIMODAN®; DMG2) contained 74% by weight mono-glyceride. The remainder of the distilled mono-glyceride composition was nearly all di-glyceride.

For comparison, commercially available glycerol mono-oleate (GMO) compositions were added to the non-aqueous lubricant. A first GMO composition ('Commercial 1') contained 13.6% by weight mono-glyceride, 21.4% by weight di-glyceride and 65.1% by weight tri-glyceride. A second GMO composition ('Commercial 2') contained 34.9% by weight mono-glyceride, 62.4% by weight di-glyceride and 2.7% by weight tri-glyceride. A third GMO composition ('Commercial 3') contained 43.0% by weight mono-glyceride, 54.1% by weight di-glyceride and 3.0% by weight tri-glyceride.

The performance of each of the lubricant compositions in the Cameron Plint wear test was assessed. As is known in the art, Cameron Plint wear tests are used to simulate reciprocating boundary friction and produce wear at higher temperatures (180° C.). The test was also carried out on the non-aqueous lubricant to provide a baseline. The Cameron Plint apparatus was set up in a pin on plate configuration. The pin was reciprocated along the plate at a frequency of 2 Hz, stroke length of 2.3 mm and with an applied pressure of 300 N. Oil was fed into the contact area at a rate of 0.8 ml/hr. Standard steel B01 Flat Plate and EN31 Roller plint components were used in these tests. The test was carried out for a period of 6 hours at 180° C. Wear volume ($mm^3$), average wear rate ($mm^3/Nm$) and maximum scar depth (mm) were measured.

The results are shown in the following table:

| | Change compared to baseline % | | |
|---|---|---|---|
| | Wear volume | Wear rate | Scar depth |
| No additive (baseline) | 0 | 0 | 0 |
| Commercial 1 | 9 | 9 | −15 |
| Commercial 2 | 2 | 2 | 40 |
| Commercial 3 | −2 | −2 | −15 |
| DMG1 | −35 | −35 | −33 |
| DMG2 | −26 | −26 | −28 |

The lubricant composition comprising the DMG compositions exhibited excellent anti-wear performance compared to each of the commercially available GMO additives, as well as a significant improvement over the baseline. This demonstrates that the ester additives defined herein are highly effective at reducing wear in lubricant compositions.

The effect of the fatty acid group on wear was conducted by testing the performance of organic friction modifiers (OFMs) enriched with stearic acid, oleic acid or linoleic acid using a Cameron Plint wear test. Slower wear rates were observed when the OFM(s) was enriched with oleic acid and linoleic acid (i.e. fatty acids comprising one or two double bonds) than with stearic acid (i.e. a saturated fatty acid).

Example 2: High Frequency Reciprocating Rig Friction Test

The lubricant compositions from Example 1 were also tested in a High Frequency Reciprocating Rig (HFRR) friction test. HFRR tests are typically used to assess the lubricity of diesel fuels. However, the tests may also be used to assess friction coefficients between sliding solid surfaces in the presence of different lubricant compositions. Thus, the test may be used to assess the performance of friction modifiers that are present in the lubricant compositions.

The HFRR apparatus was set up in a ball on plate configuration. The ball was reciprocated along the plate at a frequency of 40 Hz, stroke length of 1.0 mm and with load of 400 g. The oil was present as a static bath. The temperature increased throughout the test, starting at 40° C., then each of 60, 80, 100, 120 and 140° C. for 5 minutes, with a 10 second equilibration time at each temperature.

The results are shown in the following table:

| | Friction (change compared to baseline %) | |
|---|---|---|
| | 40° C. | 140° C. |
| No additive (baseline) | 0 | 0 |
| Commercial 1 | −3 | −17 |
| Commercial 2 | −10 | −34 |
| Commercial 3 | −6 | −31 |
| DMG | −12 | −35 |

The lubricant composition comprising the DMG composition exhibited superior friction-modifying performance than the lubricant compositions comprising the commercially available GMO additives and the baseline, at both low and high temperatures. This demonstrates that the ester additives defined herein may also be effectively used as anti-wear additives.

Example 3: ISOT and HPLS Oxidation Tests

The oxidative stabilities of the lubricant compositions from Example 1 comprising DMG1 and DMG2 were tested, along with a further lubricant composition comprising a different DIMODAN® distilled mono-glyceride additive (DMG3). For comparison, the lubricant 'Commercial 2' from Example 1 was also tested. The lubricant compositions were subjected to The Indiana Stirring Oxidation Test (ISOT, JIS K2514-1982), a method of determining the oxidation stability of lubricating oils which focuses on engine oil degradation, and The Hot Liquid Process Simulator, a method for assessing the lubricant thermal oxidative stability.

All three of the DMG-containing lubricants exhibited comparable or improved oxidative stability compared to the Commercial 2 lubricant.

Example 4: OM646LA Engine Wear Test

Some of the lubricant additives from Example 1 were formulated for further testing in an OM646LA (CEC L-99-08) engine wear test. This test evaluates engine lubricant performance by looking at engine wear under severe operating conditions that are typical in a diesel engine.

The test was carried out in accordance with the OM646LA (CEC L-99-08) specification.

The results are shown the following table:

| | Outlet camshaft wear reduction (compared to baseline %) |
|---|---|
| No additive (baseline) | — |
| DMG | 71% |
| Commercial 1 | 16% |
| Commercial 3 | 51% |

FIG. 1 is a graph showing the % outlet camshaft wear reduction that was achieved by each of the lubricant compositions as compared to the baseline lubricant in the OM646LA engine test.

The lubricant composition comprising the DMG composition showed excellent anti-wear properties in the test. In comparison, the lubricant compositions containing the first and second commercially available GMO compositions exhibited small and moderate improvements over the baseline, respectively. Thus, the results demonstrate that an ester additive defined herein exhibits superior anti-wear properties as compared to ester additives containing less than 50% by weight mono-ester.

The test was repeated using a different baseline lubricant composition and similar results were obtained.

The invention claimed is:

1. A lubricant composition comprising an anti-wear and/or friction modifying additive which is an ester of a fatty acid and a polyol, wherein at least 50% by weight of the additive is in the form of a mono-ester, and wherein at least 40% by weight of the fatty acid in the mono-ester is a mixture of oleic acid and linoleic acid.

2. The lubricant composition of claim 1, wherein the ratio by weight of linoleic acid to oleic acid in the mono-ester is from 1:10 to 6:1.

3. The lubricant composition of claim 1, wherein the polyol is selected from $C_{2-10}$ polyols.

4. The lubricant composition of claim 1, wherein the polyol comprises from 3 to 5 hydroxyl groups.

5. The lubricant composition of claim 4, wherein the polyol is glycerol.

6. The lubricant composition of claim 5, wherein at least 80% by weight of the mono-ester is in the form of a 1-mono-glyceride.

7. The lubricant composition of claim 1, wherein the additive is present at a concentration of from 0.02 to 5% weight of the lubricant composition.

8. A method for preparing a lubricant composition as defined in claim 1, said method comprising blending:

an oil of lubricating viscosity; and an anti-wear and/or friction modifying additive which is an ester of a fatty acid and a polyol, wherein at least 50% by weight of the additive is in the form of a mono-ester.

9. A method for increasing the anti-wear and/or friction-modifying properties of a lubricant composition, said method comprising introducing an additive which is an ester of a fatty acid and a polyol, wherein at least 50% by weight of the additive is in the form of a mono-ester, and wherein at least 40% by weight of the fatty acid in the mono-ester is a mixture of oleic acid and linoleic acid, to the lubricant composition.

10. A method for reducing wear and/or friction on a surface, said method comprising applying a lubricant composition as defined in claim 1 to the surface.

11. A method for improving the fuel economy and/or power of an internal combustion engine, said method comprising supplying a lubricant composition as defined in claim 1 to the engine.

12. The method of claim 10, wherein the surface is a surface in an internal combustion engine, marine engine or application, robotics application, or turbine.

13. The method of claim 10, wherein the surface is a surface in an internal combustion engine.

14. The method of claim 10, wherein the surface is a wheel bearing, door hinge, gear, transmission, drive line, or clutch.

15. A method for working a metal, said method comprising supplying a lubricant composition as defined in claim 1 to the metal.

16. The method of claim 15, wherein working the metal comprises machining, rolling, or a combination thereof.

17. The lubricant composition of claim 1, wherein the ratio by weight of linoleic acid to oleic acid in the mono-ester is from 1:8 to 6:1.

18. The lubricant composition of claim 1, wherein the ratio by weight of linoleic acid to oleic acid in the monoester is from 1:5 to 3:1.

* * * * *